US007985869B2

(12) United States Patent
Hutchison et al.

(10) Patent No.: US 7,985,869 B2
(45) Date of Patent: Jul. 26, 2011

(54) COMPOSITIONS OF AU-11 NANOPARTICLES AND THEIR OPTICAL PROPERTIES

(75) Inventors: James E. Hutchison, Eugene, OR (US); Gerd H. Woehrle, Eugene, OR (US)

(73) Assignee: State of Oregon Acting by and Through the State Board of Higher Education on Behalf of the University of Oregon, Eugene, OR (US)

( * ) Notice: Subject to any disclaimer, the term of this patent is extended or adjusted under 35 U.S.C. 154(b) by 729 days.

(21) Appl. No.: 11/920,564

(22) PCT Filed: May 22, 2006

(86) PCT No.: PCT/US2006/019859

§ 371 (c)(1),
(2), (4) Date: Nov. 16, 2007

(87) PCT Pub. No.: WO2008/054338

PCT Pub. Date: May 8, 2008

(65) Prior Publication Data

US 2009/0312565 A1 Dec. 17, 2009

Related U.S. Application Data

(60) Provisional application No. 60/683,109, filed on May 20, 2005.

(51) Int. Cl.
*C07F 1/12* (2006.01)

(52) U.S. Cl. ..... 556/9; 556/13; 556/113; 977/830

(58) Field of Classification Search ..... 556/9, 13, 556/113; 977/830
See application file for complete search history.

(56) References Cited

U.S. PATENT DOCUMENTS

| | | | |
|---|---|---|---|
| 4,522,932 | A | 6/1985 | Mitchell, III |
| 5,242,877 | A | 9/1993 | Dobson et al. |
| 5,389,401 | A | 2/1995 | Gordon |
| 5,521,289 | A | 5/1996 | Hainfeld et al. |

(Continued)

FOREIGN PATENT DOCUMENTS

| | | |
|---|---|---|
| WO | WO98/53841 | 12/1998 |

OTHER PUBLICATIONS

Hawley's Condensed Chemical Dictionary, Thirteenth Edition, John Wiley & Sons, Inc., p. 94 (1997).*

(Continued)

*Primary Examiner* — Porfirio Nazario Gonzalez
(74) *Attorney, Agent, or Firm* — Klarquist Sparkman, LLP

(57) ABSTRACT

As demonstrated herein, the ligand exchange chemistry of phosphine-stabilized $Au_{11}$ clusters with ω-functionalized thiols is a powerful synthetic method that provides convenient access to a diverse family of functionalized $Au_{11}$ clusters. The general nature of the presented ligand exchange approach, in combination with the ease preparation, makes this approach of broad utility. The approach is general and shows the high tolerance for a wide variety of functional groups. Mechanistic studies provided conclusive evidence that the $Au_{11}$ core of the precursor particle remains intact during ligand exchange and showed that the ligand exchange of these particles follows a different pathway than for ligand exchanges of larger gold nanoparticles such as "$Au_{101}(PPh_3)_{21}Cl_5$". Optical studies of the products show a strong dependence on the nature of the stabilizing thiol ligands.

19 Claims, 7 Drawing Sheets

Scheme 1. Schematic representation of the ligand exchange reaction of $Au_{11}(PPh_3)_8Cl_3$ and ω-functionalized thiols.

| | | | |
|---|---|---|---|
| organic-soluble: | R = | $-(CH_2)_nCH_3$ | n = 2, 5, 7, 11, 15, 17 |
| | | -p-Ph-OH | |
| | | -p-Ph-$CH_3$ | |
| | | -p-Ph-Ph | |
| | | $-(CH_2)_3Si(OCH_3)_3$ | |
| water-soluble: | R = | $-(CH_2)_nCOOH$ | n = 1, 2, 6, 11 |
| | | $-(CH_2CH_2O)_nCH_2CH_2OH$ | n = 1, 2 |
| | | $-(CH_2)_2PO(OH)_2$ | |
| | | $-(CH_2)_2NHMe_2^+Cl^-$ | |
| | | $-(CH_2)_2N^+(CH_3)_3Cl^-$ | |
| | | $-(CH_2CH_2O)_nCH_2CH_2NMe_3^+Cl^-$ | n = 1,2 |
| | | $-(CH_2)_2SO_3^-Na^+$ | |

U.S. PATENT DOCUMENTS

| | | | | |
|---|---|---|---|---|
| 5,536,858 | A | 7/1996 | LaLonde et al. | |
| 5,578,248 | A | 11/1996 | Hattori et al. | |
| 5,952,172 | A | 9/1999 | Meade et al. | |
| 6,121,425 | A | 9/2000 | Hainfeld et al. | |
| 7,326,954 | B2 | 2/2008 | Wybourne et al. | |
| 7,626,192 | B2 * | 12/2009 | Hutchison et al. | 257/9 |
| 2002/0016306 | A1 | 2/2002 | Hutchison et al. | |
| 2002/0146742 | A1 | 10/2002 | Wybourne et al. | |
| 2003/0077625 | A1 | 4/2003 | Hutchison | |
| 2003/0159927 | A1 | 8/2003 | Lewis et al. | |
| 2003/0215816 | A1 | 11/2003 | Sundararajan et al. | |
| 2003/0231304 | A1 | 12/2003 | Chan et al. | |

OTHER PUBLICATIONS

International Search Report and Written Opinion of the International Searching Authority, mailed Aug. 20, 2008, from PCT Application No. PCT/US2006/019859.

Woehrle et al., "Thiol-Functionalized, 1.5-nm Gold Nanoparticles through Ligand Exchange Reactions: Scope and Mechanism of Ligand Exchange," *J Am Chem. Soc.* 127(7):2172-2183, 2005.

Zeppenfeld et al., "Variation of Layer Spacing in Self-Assembled Hafnium-1,10-Decanediylbis(phosphonate) Multilayers As Determined by Ellipsometry and Grazing Angle X-ray Diffraction," *J. Am. Chem. Soc.* 116(20):9158-9165, 1994.

International Search Report and Written Opinion of the International Searching Authority from PCT/US2006/019861, mailed Aug. 3, 2007.

International Search Report and Written Opinion of the International Searching Authority from PCT/US2006/018716, mailed Nov. 6, 2007.

Alivisatos, et al., Organization of Nanocrystal Molecules using DNA, Nature, 382:609-611 (1996).

Andres, et al., Coulomb Staircase at Room Temperature in a Self-Assembled Molecular Nanostructure, Science, 272:1323-1325 (1996).

Andres, et al., Self-Assembly of a Two-Dimensional Superlattice of Molecularly Linked Metal Clusters, Science, 273:1690-1693 (1996).

Bartlett, et al., Synthesis of Water-Soluble Undecagold Cluster Compounds of Potential Importance in Electron Microscopic and Other Studies of Biological Systems, J. Am. Chem. Soc., 100:5085-5089 (1978).

Braun, et al., DNA-Templated Assembly and Electrode Attachment of a Conducting Silver Wire, Nature, 391:775-778 (1998).

Brown, et al., Convenient Preparation of Stable, Narrow-Dispersity, Gold Nanocrystals by Ligand Exchange Reactions, J. Am. Chem. Soc., 119:12384-12385 (1997).

Brust, et al., Novel Gold-Dithiol Nano-Networks with Non-Metallic Electronic Properties, Adv. Mater, 7:795-797 (1995).

Clarke, et al., Fabrication and Near-Room Temperature Transport of Patterned Gold Cluster Structures, J. Vac. Sci. Technol. B, 15:2925-2929 (1997).

Feldheim, et al., Electron Transfer in Self-Assembled Inorganic Polyelectrolyte/Metal Nanoparticle Heterostructures, J. Am. Chem. Soc., 118:7640-7641 (1996).

Geerligs, et al., Frequency-Locked Turnstile Device for Single Electrons, Phys. Rev. Lett., 64:2691-2694 (1990).

Grabar, et al., Preparation and Characterization of Au Colloid Monolayers, Anal. Chem., 67:735-743 (1995).

International Search Report for International Application No. PCT/US03/20500.

Itou, S., Reorientation of Poly-γ-Benzyl L-Glutamate Liquid Crystals in an Electric Field, Jpn. J. Appl. Phys., 24:1234-1235.(1985).

Likharev, K., Correlated Discrete Transfer of Single Electrons in Ultrasmall Tunnel Junctions, IBM J. Res. Dev., 32:144-158 (1988).

Mirkin, et al., A DNA-Based Method for Rationally Assembling Nanoparticles into Macroscopic Materials, Nature, 382:607-609 (1996).

Niemeyer, C., DNA as a Material for Nanotechnology, Angew. Chem., Int. Ed. Engl., 36:585-587 (1997).

O'Konski, et al., Electric Properties of Macromolecules. IV. Determination of Electric and Optical Parameters From Saturation of Electric Birefringence in Solutions, J. Phys. Chem., 63:1558-1565 (1959).

Osifchin, et al., Synthesis of a Quantum Dot Superlattice using Molecularly Linked Metal Clusters, Superlattices and Microstructures, 18:283-289 (1995).

Peschel, et al., First Steps Towards Ordered Monolayers of Ligand-Stabilized Gold Clusters, Angew Chem. Int. Ed. Engl., 34:1442-1443 (1995).

Pothier, et al., Single-Electron Pump Based on Charging Effects, Europhys. Lett., 17:249-254 (1992).

Qi, et al., Ligation of Triangles Built from Bulged 3-Arm DNA Branched Junctions. J. Am. Chem. Soc., 118:6121-6130 (1996).

Schmid, G., Hexachlorododecakis(triphenylphosphine)pentapentacontagold. $Au_{55}[P(C_6H_5)_3]_{12}CI_6$, Inorg. Syn., 27:214-218 (1990).

Schön, et al., A Fascinating New Field in Colloid Science: Small Ligand-Stabilized Metal Clusters and their Possible Application in Microelectronics, Colloid Polym. Sci., 273:202-218 (1995).

Seeman, N., DNA Components for Molecular Architecture, Accounts of Chemical Research, 30:357-363 (1997).

Simon, et al., The Application of $Au_{55}$ Clusters as Quantum Dots, Angew. Chem. Int. Ed. Engl., 32:250-254 (1993).

Storhoff, et al., Programmed Materials Synthesis with DNA, Chem. Rev., 99:1849-1862 (1999).

Whitesell, et al., Directionally Aligned Helical Peptides on Surfaces, Science, 261:73-76 (1993).

Wybourne, et al., Coulomb-Blockade Dominated Transport in Patterned Gold-Cluster Structures, Jpn. J. Appl. Phys., 36:7796-7800 (1997).

Yano, et al., Transport Characteristics of Polycrystalline-Silicon Wire Influenced by Single-Electron Charging at Room Temperature, Appl. Phys. Lett., 67:828-830 (1995).

* cited by examiner

Scheme 1. Schematic representation of the ligand exchange reaction of $Au_{11}(PPh_3)_8Cl_3$ and ω-functionalized thiols.

| | | | |
|---|---|---|---|
| organic-soluble: | R = | $-(CH_2)_nCH_3$ | n = 2, 5, 7, 11, 15, 17 |
| | | -*p*-Ph-OH | |
| | | -*p*-Ph-$CH_3$ | |
| | | -*p*-Ph-Ph | |
| | | $-(CH_2)_3Si(OCH_3)_3$ | |
| water-soluble: | R = | $-(CH_2)_nCOOH$ | n = 1, 2, 6, 11 |
| | | $-(CH_2CH_2O)_nCH_2CH_2OH$ | n = 1, 2 |
| | | $-(CH_2)_2PO(OH)_2$ | |
| | | $-(CH_2)_2NHMe_2^+Cl^-$ | |
| | | $-(CH_2)_2N^+(CH_3)_3Cl^-$ | |
| | | $-(CH_2CH_2O)_nCH_2CH_2NMe_3^+Cl^-$ | n = 1,2 |
| | | $-(CH_2)_2SO_3^-Na^+$ | |

Table 1. Analytical Data for the Ligand Exchange Products

| Ligand | Reaction time | $d_{core}$ [a] | $^1$H NMR chemical shift (ppm) and NMR solvent | S:Au ratio [b] | % ligand by mass [c] |
|---|---|---|---|---|---|
| $HS(CH_2)_5CH_3$ [d] | 6 h | 0.8 ± 0.2 ($N$ = 1103) | 1.15 (b) $CDCl_3$ | 0.96 | 23.9 |
| | | | 1.79 (b) | | |
| $HS(CH_2)_9CH_3$ [d] | 10 h | 0.8 ± 0.2 ($N$ = 623) | 0.90 (b) $CDCl_3$ | 0.93 | 36.9 |
| | | | 1.32 (b) | | |
| | | | 1.80 (b) | | |
| $HS(CH_2)_{13}CH_3$ [d] | 14 h | 0.7 ± 0.2 ($N$ = 920) | 0.88 (b) $CDCl_3$ | 0.86 | 41.6 |
| | | | 1.27 (b) | | |
| $HS(CH_2)_{11}CH_3$ [d] | 16 h | 0.8 ± 0.3 ($N$ = 1032) | 0.90 (b) $CDCl_3$ | 0.91 | 47.1 |
| | | | 1.25 (b) | | |
| $HS(CH_2)_{15}CH_3$ [d] | 20 h | 0.8 ± 0.2 ($N$ = 810) | 0.89 (b) $CDCl_3$ | 0.87 | 53.8 |
| | | | 1.27 (b) | | |
| $HS(CH_2)_{17}CH_3$ [d] | 24 h | 0.8 ± 0.2 ($N$ = 623) | 0.89 (b) $CDCl_3$ | 0.89 | 56.1 |
| | | | 1.26 (b) | | |
| 4-mercaptophenol [d] | 24 h [e] | 0.8 ± 0.2 ($N$ = 902) | 7.23 (b) $CD_3OD$ | 0.92 | 36.7 |
| 4-methylbenzenethiol [d] | 20 h | 0.7 ± 0.2 ($N$ = 718) | 1.80 (b) $CDCl_3$ | 0.89 | 35.7 |
| | | | 7.11 (b) | | |
| 4-mercaptobiphenyl [d] | 20 h | 0.8 ± 0.2 ($N$ = 512) | 7.32 (b) $CD_2Cl_2$ | 0.86 | 44.8 |
| $HS(CH_2)_3Si(OCH_3)_3$ [d] | 18 h | 0.8 ± 0.3 ($N$ = 627) | 3.40 (b) $CD_3OD$ | 1.01 | 46.1 |
| | | | 3.91 (b) | | |
| $HS(CH_2)COOH$ [e] | 3 h | 0.9 ± 0.2 ($N$ = 651) | 3.10 (b) $CD_3OD$ | 0.81 | 28.8 |

FIG. 2A

| Ligand | Reaction time | $d_{core}$ [a] | $^1$H NMR chemical shift (ppm) and NMR solvent | S:Au ratio [b] | % ligand by mass [c] |
|---|---|---|---|---|---|
| $HS(CH_2)_2COOH$ [d] | 4 h | 0.8 ± 0.2 ($N$ = 564) | 3.30 (b) $CD_3OD$ | 0.76 | 31.1 |
| $HS(CH_2)_3COOH$ [e] | 8 h | 0.9 ± 0.3 ($N$ = 812) | 1.21 (b) $CD_3OD$ | 0.80 | 38.9 |
| | | | 2.10 (b) | | |
| $HS(CH_2)_{11}COOH$ [e] | 12 h | 0.8 ± 0.2 ($N$ = 712) | 1.31 (b) $CD_3OD$ | 0.74 | 46.8 |
| | | | 1.55 (b) | | |
| | | | 2.14 (b) | | |
| $HS(CH_2)_2O(CH_2)_2OH$ [f] | 10 h | 0.8 ± 0.2 ($N$ = 1034) | 3.73 (b) $D_2O$ | 0.90 | 35.0 |
| $HS(CH_2)_2O(CH_2)_2O(CH_2)_2OH$ [f] | 15 h | 0.8 ± 0.3 ($N$ = 832) | 3.71 (b) $D_2O$ | 0.83 | 41.5 |
| $HS(CH_2)_3PO(OH)_2$ [f] | 7 h | 0.9 ± 0.2 ($N$ = 591) | 3.51 (b) $D_2O$ | 1.02 | 39.7 |
| | | | 3.27 | | |
| | | | 2.26 (b) | | |
| $HS(CH_2)_2NMe_2 \cdot HCl$ [f] | 9 h | 0.9 ± 0.2 ($N$ = 704) | 2.93 (b) $D_2O$ | 0.74 | 35.1 |
| | | | 3.55 (b) | | |
| | | | 3.80 (b) | | |
| $HS(CH_2)_2NMe_3^+Cl^-$ [f] | 4 h | 0.8 ± 0.3 ($N$ = 923) | 3.13 (b) $D_2O$ | 0.84 | 38.0 |
| | | | 3.52 (b) | | |
| $HS(CH_2)_2O(CH_2)_2NMe_3^+Cl^-$ [f] | 8 h | 0.8 ± 0.2 ($N$ = 689) | 3.11 (b) $D_2O$ | 0.79 | 44.2 |
| | | | 3.62 (b) | | |
| $HS(CH_2)_2O(CH_2)_2O(CH_2)_2NMe_3^+Cl^-$ [f] | 9 h | 0.8 ± 0.3 ($N$ = 834) | 1.65(b) $D_2O$ | 0.92 | 49.7 |
| | | | 3.18 (b) | | |
| $HS(CH_2)_2SO_3^-Na^+$ [f,g] | 10 h | 0.8 ± 0.2 ($N$ = 783) | 3.42 (b) $D_2O$ | 0.94 | 39.1 |
| | | | 3.75 (b) | | |

[a] Core diameter in nm (mean ± std dev) from analysis of representative TEM images. $N$ refers to the number of particles measured. [b] Ratio obtained from quantification of the areas of the XPS signals. [c] Obtained from TGA analysis. [d] Synthesized according to the general procedure for the preparation of organic-soluble nanoparticles. [e] Synthesized according to the general procedure for the preparation of water-soluble nanoparticles but using a 3:1 $KH_2PO_4/K_2HPO_4$ buffer (pH 8) as the aqueous phase. [f] Synthesized according to the general procedure for the preparation of water-soluble nanoparticles. [g] This material is obtained in a two-step synthesis as described elsewhere.[5] [h] The reaction is carried out in $CH_3Cl$:MeOH (1:1).

FIG. 2B

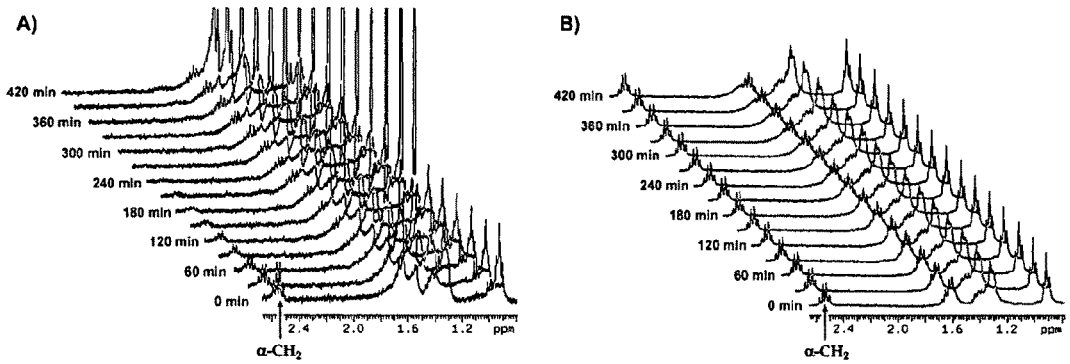

Evolution of the α-methylene (α-$CH_2$) resonance of hexanethiol as a function of time for the ligand exchange of 1 with hexanethiol monitored by $^1H$ NMR spectroscopy. (A) The reaction was carried out in the presence a stochiometric amount of hexanethiol to replace all of the ligands of 1. The intensity of the α-$CH_2$ resonance decreases over time as the thiols are exchanged onto the nanoparticle until it is broadened into the base line after completion of the exchange. (B) The reaction was carried out under identical conditions as the experiment in (A) but in the presence of a 4-fold molar excess of $PPh_3$ over hexanethiol added prior to ligand exchange. The intensity of the α-$CH_2$ resonance remains unchanged throughout the measurement, indicating complete blocking of the ligand exchange.

FIG. 3

Scheme 3. Differences in the mechanism for the ligand exchange of phosphine-stabilized gold nanoparticles with ω-functionalized thiols.

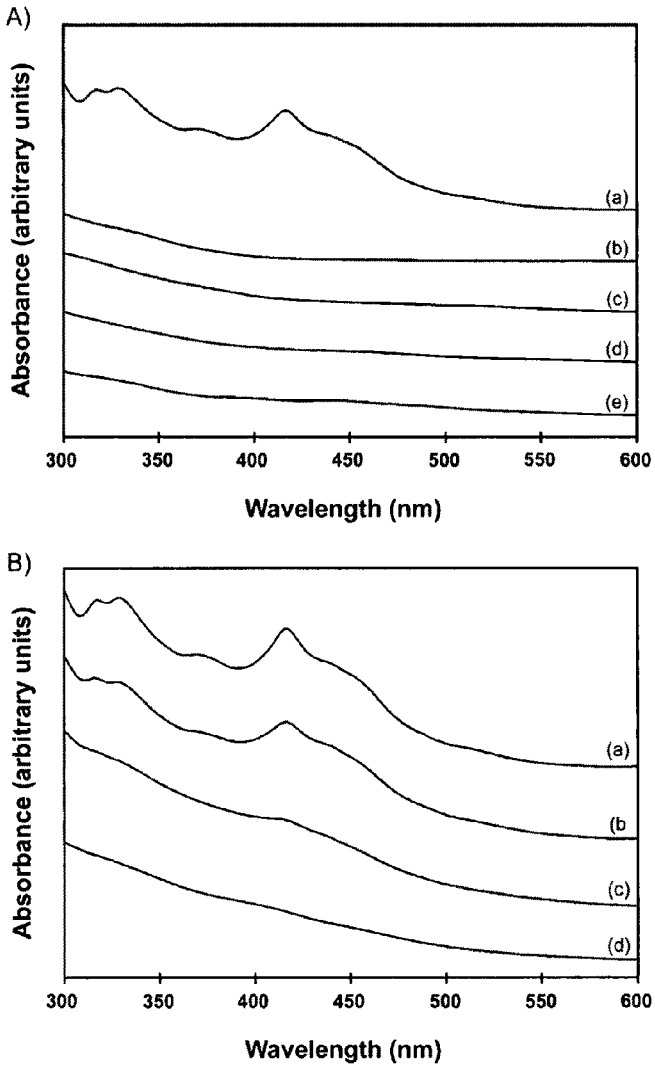

Dependence of the UV-visible spectra of thiol-stabilized Au11 particles on the nature of the ligand shell. The spectra were normalized at 600 nm. (A) Comparison of the optical properties of organic-soluble and water-soluble Au11 particles stabilized by (a) octadecanethiol, (b) mercaptoethanesulfonate, (c) mercaptopropionic acid, (d) mercaptoethanephosphonic acid, and (e) (*N,N*dimethylamino) ethanethiol. (B) Dependence of the UV-visible spectra of organic-soluble Au11 particles stabilized with straight-chain alkanethiols on the chain length. The stabilizing ligands were (a) octadecanethiol, (b) dodecanethiol, (c) octanethiol, and (d) hexanethiol.

FIG. 5

UV-visible spectrum of (a) organic-soluble $Au_{11}$ particles obtained by the ligand exchange of 1 with hexanethiol, (b) the thiol-stabilized $Au_{11}$ particles from (a) after a second ligand exchange with ODT, and (c) $Au_{11}$-$SC_{18}$ prepared directly by ligand exchange of 1 with ODT. All spectra were normalized at 600 nm.

COMPOSITIONS OF AU-11 NANOPARTICLES AND THEIR OPTICAL PROPERTIES

CROSS REFERENCE TO RELATED APPLICATION APPLICATIONS

This is the 35 U.S.C. §371 U.S. National Stage of International Application No. PCT/US2006/019859, filed May 22, 2006, which claims the benefit of the earlier filing date of U.S. provisional application No. 60/683,109, filed May 20, 2005, and which is incorporated herein by reference.

ACKNOWLEDGEMENT OF GOVERNMENT SUPPORT

This invention was made with government support under Grant No. DGE DMR-9705343 awarded by the National Science Foundation. The government has certain rights in the invention.

FIELD

Disclosed herein are novel undecagold nanoparticles, methods for making such particles and application of their optical properties.

BACKGROUND

Metal nanoparticles with subnanometer core dimensions are of interest for fundamental studies and may be useful as building blocks for nanoscale devices because they are small enough to possess discrete electronic states and can exhibit semiconductor-like electronic properties. To date, such nanoparticles have not been exploited due in part to the lack of convenient access to ligand-stabilized nanoparticles possessing terminal functional groups.

SUMMARY

Disclosed herein is a convenient and general approach for the rapid preparation of large families of thiol-stabilized, subnanometer (dCORE ~0.8 nm) particles. The approach permits rapid incorporation of specific functionality into the stabilizing ligand shell, is tolerant of a wide range of functional groups, and provides convenient access to new materials inaccessible by other methods.

Also disclosed herein are novel nanoparticles. In one embodiment the nanoparticles prepared as described herein have useful optical properties. In one embodiment, the properties of the thiol-stabilized nanoparticles depend strongly on the composition of the ligand shell. In a particular embodiment, the optical properties of the nanoparticles can be tuned by altering the ligand shell composition. Such tuning can be accomplished in principle by affecting the electronic structure of the particle core and/or effecting a structural change within the nanoparticle core. However, as disclosed herein, typically the properties are affected via the electronic structure of the core.

Exemplary nanoparticles disclosed herein have a ligand of the formula —SRX, wherein R represents a linker, such as $—(CH_2)_n—$; optionally substituted aryl; or $—(CH_2CH_2O)_nCH_2CH_2—$; X represents, without limitation, $—R^1$, $—Si(OCH_3)_3$; $—P(O)(OR^2)_2—N(CH_3)_3Cl$; or —OR; each n independently is an integer from 1 to 20; $R^1$ is H or lower alkyl and $R^2$ is H, lower alkyl, aralkyl or aryl.

The foregoing and other objects, features, and advantages of the invention will become more apparent from the following detailed description, which proceeds with reference to the accompanying figures.

BRIEF DESCRIPTION OF THE DRAWINGS

FIG. 2A records analytical data for ligand exchange products.

FIG. 2B records analytical data for additional ligand exchange products.

FIG. 3A charts the evolution of the α-methylene (α-$CH_2$) resonance of hexanethiol as a function of time for the ligand exchange of 1 with hexanethiol monitored by $^1H$ NMR spectroscopy.

FIG. 3B charts the α-$CH_2$ resonance for the ligand exchange reaction monitored in FIG. 3A, but with the presence of a 4-fold molar excess of $PPh_3$ over hexanethiol added prior to ligand exchange.

FIG. 5 illustrates the dependence of the UV-visible spectra of thiol-stabilized $Au_{11}$ particles on the nature of the ligand shell.

DETAILED DESCRIPTION

Figure 1:
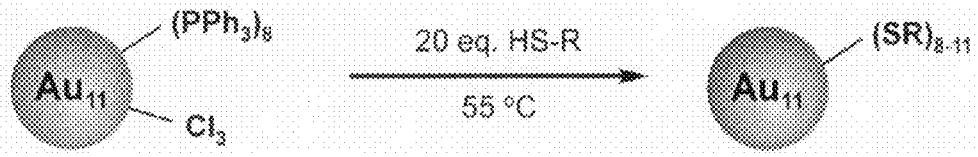
FIG. 1 is a schematic representation of the ligand exchange reaction of $Au_{11}(PPh_3)_8Cl_3$ and ω-functionalized thiols.

Until now, the lack of general synthetic strategies to introduce specific functionalities into the terminal positions of the ligand shell has limited detailed experimental investigations of the properties and reactivities of these materials. Although a number of small transition metal clusters with less than 20 core atoms have been studied for use as coordination complexes, catalysts, and tagging reagents for biomolecules, the vast majority of these clusters are stabilized by ligands (e.g., CO, Cp, $H_2O$, halides etc.) that lack the chemical functionality needed to specifically bind the clusters to molecules, substrates, and surfaces. Most examples of the introduction of functional groups into the ligand shell of subnanometer particles involve the use of functionalized triarylphosphines. The synthesis of functionalized triarylphosphine-stabilized undecagold ($Au_{11}$) clusters typically requires an involved series of synthesis and separation steps, including phosphine-for-phosphine ligand exchange reactions, postsynthetic transformations of functional groups, and ion exchange chromatography. The limited availability of functionalized phosphines and need for multi-step transformations and separations limit the utility of these approaches as convenient and general routes to a diverse family of functionalized clusters. In addition, triarylphosphine-stabilized clusters exhibit only limited solution stability, especially in acidic solution, and are often prone to oxidative decomposition under ambient conditions. A potential solution to enhancing the stability of these clusters involves stabilization through thiol ligands. Thiol-stabilized nanoparticles exhibit higher stability than the phosphine-stabilized nanoparticles; however, only a few examples of thiol-stabilized nanoparticles with subnanometer core dimensions are available. See, for example, Schaaff, T. G.; Shafigullin, M. N.; Khoury, J. T.; Vezmar, I.; Whetten, R. L.; Cullen, W. G.; First, P. N.; Wing, C.; Ascensio, J.; Yacaman, M. J. *J. Phys. Chem. B* 1997, 101, 7885-7891; Yang, Y.; Chen, S. *Nano Lett.* 2003, 3, 75-79; Woehrle, G. H.; Warner, M. G.; Hutchison, J. E. *J. Phys. Chem. B* 2002, 106, 9979-9981;

Schaaff, T. G.; Whetten, R. L. *J. Phys. Chem. B* 2000, 104, 2630-2641; and Negishi, Y.; Tsukuda, T. *J. Am. Chem. Soc.* 2003, 125, 4046-4047.

Disclosed herein is the ligand exchange of triphenylphosphine-stabilized undecagold (Au11) precursor particles (dCORE ~0.8 nm) with co-functionalized thiols as a reliable and convenient approach for producing functionalized, sub-nanometer gold particles (Woehrle, G. H.; Warner, M. G.; Hutchison, J. E. *J. Phys. Chem. B* 2002, 106, 9979-9981, which is incorporated herein by reference). Initial studies demonstrated successful ligand exchange of $Au_{11}(PPh_3)_8Cl_3$ with a three different thiols but the broader scope of the presently disclosed approach was not apparent. Also disclosed herein is the surprising dependence of the optical properties of the thiol-stabilized product particles on the thiol ligand used during ligand exchange. Recent mechanistic work showed that the ligand exchange of 1.5-nm phosphine-stabilized gold nanoparticles with thiols results in the loss of gold core atoms. Although core size analysis by transmission electron microscopy (TEM) suggested that Au11 core is preserved during ligand exchange, small changes in the number of core atoms are undetectable by TEM. Thus, whether core size changes occur during the ligand exchange of phosphine-stabilized Au11 clusters with thiols and whether such changes are responsible for the observed differences in the optical properties was investigated. Described herein is the ligand exchange reaction of $Au_{11}(PPh_3)_8Cl_3$ with a wide range of ω-functionalized thiols. The approach is convenient and tolerates organic- and water-soluble thiols with neutral or charged head groups. As further described herein, mechanistic studies of the exchange reaction provide strong evidence that the core size of the precursor particle remains unchanged during the ligand exchange. These studies demonstrate that, during the exchange of thiols for phosphines, the phosphine ligands are lost as free triphenylphosphine. Therefore, undecagold particles follow a different mechanism for exchange reactions with thiols than their larger (dCORE ~1.5 nm) analogs. Surprisingly, the optical properties of the thiol-stabilized exchange products depend on the nature of the ligand shell.

The nanoparticles disclosed herein optionally can be combined with the methods disclosed in Provisional Application No. 60/680,919, entitled METHOD FOR FUNCTIONALIZING SURFACES, and filed May 13, 2005, in the names of James E. Hutchison, Christina E. Inman, Gregory J. Kearns, Shuji Goto and Evan Foster, which is incorporated herein by reference in its entirety. Also incorporated herein by reference is Provisional Application No. 60/683,140, entitled NANOPARTICLES AND METHOD TO CONTROL NANOPARTICLE SPACING, and filed May 20, 2005, in the names of James E. Hutchison, Gerd H. Woehrle, Marvin G. Warner and Leif O. Brown.

Exemplary ligands suitable for use in the disclosed nanoparticles include those of the formula —SRX, wherein R represents a linker, such as $—(CH_2)_n—$; optionally substituted aryl; $—(CH_2CH_2O)_n—$, or $—(CH_2CH_2O)_nCH_2CH_2—$; X represents $—R^1$, $—Si(OCH_3)_3$; $—P(O)(OR^2)_2—N(CH_3)_3Cl$; or —OR; each n independently is an integer from 1 to 20; $R^1$ is H or lower alkyl and $R^2$ is H, lower alkyl, aralkyl or aryl. In particular embodiments X represents a phosphonate moiety, $—P(O)(OH)_2$. In other embodiments X represents a phosphonic acid ester, $—P(O)(OR^2)_2$, examples of suitable $R^2$ groups include, without limitation, aralkyl groups, such as benzyl groups; aryl groups, such as phenyl; and lower alkyl groups, such as methyl, ethyl or t-butyl. In particular embodiments the ligand has the formula $—S(CH_2CH_2)_nP(O)(OH)_2$ wherein n is 2, 3, 5 or 10.

In certain embodiments, disclosed ligand-stabilized nanoparticles are organic soluble. Suitable ligands for organic-soluble nanoparticles include, without limitation optionally substituted lower alkyl, optionally substituted aryl, optionally substituted aralkyl and combinations thereof. In one embodiment, ligands for organic-soluble nanoparticles are alkyl having the formula $—(CH_2)_nCH_3$ wherein n is from 2 to 20, such as 2, 5, 7, 11, 15 or 17. In certain embodiments such ligands are substituted, such as with one or more silyl groups, particularly siloxy groups. Examples of such silyl groups have the formula $—SiR^3R^4R^5$, wherein $R^{3-5}$ independently are selected from lower alkyl and lower alkoxy. One example of a ligand having a silyl group has the formula $—(CH_2)_nSi(OCH_3)_3$ wherein n is from 2 to 20, such as from 3 to 10. Additional suitable ligands for organic-soluble nanoparticles include optionally substituted aryl groups, including, without limitation phenyl, biphenyl and substituted phenyl and biphenyl, such as phenol or toluoyl groups.

Additional embodiments include water-soluble ligand-stabilized nanoparticles. Examples of suitable ligands for water-soluble nanoparticles include those substituted with polar moieties, such as heteroatoms. In certain examples water-soluble nanoparticles have ligands including one or more ionizable groups, such as an acidic or basic moiety, including, without limitation, basic groups, such as amino and guanidino groups; and acidic groups, such as carboxylic acid, sulfonic acid and phosphonic acid moieties. In particular examples such ligands include more than one polar moiety, such as an ether group and an ionizable group in the same ligand. Exemplary ligands for water-soluble nanoparticles include, without limitation, those of the formula $—(CH_2CH_2O)_nX$, $—(CH_2CH_2O)_nCH_2CH_3$, $—(CH_2)_nCOOH$, $—(CH_2)_nN(CH_3)_3Cl$, $—(CH_2CH_2O)_nCH_2CH_2X$, wherein X represents $—P(O)(OR^2)_2—N(CH_3)_3Cl$; or —OR; wherein n is from 1 to 20, such as from 2 to 12, in particular 1, 2, 6 or 11.

Typically the undecagold particles disclosed herein have from about 8 to about 11 ligands coordinated thereto. In particular embodiments the particles can have plural copies of the same ligand or different ligands coordinated to the metal core. Most typically the particles include 8, 9, 10 or 11 copies of the same ligand coordinated to the metal core.

EXAMPLES

General Methods and Materials

Hydrogen tetrachloroaurate was purchased from Strem and used as received. Dichloromethane was dried over calcium hydride and distilled prior to use. Chloroform was filtered through a plug of basic alumina prior to use to remove acidic impurities. Triphenylphosphine-stabilized undecagold particles, $Au_{11}(PPh_3)_8Cl_3$ (1), were synthesized as described previously and had a core diameter of 0.8±0.2 nm. 1-Azido-2,4-dinitrobenzene, 19 2-(2-mercaptoethoxy)-ethanol, and 2-[2-(2-mercaptoethoxy)-ethoxy]-ethanol20 were synthesized according to known procedures (See, Woehrle, G. H.; Warner, M. G.; Hutchison, J. E. *Langmuir* 2004, 20, 5982-5988, which is incorporated herein by reference). 2,4-Dinitrophenylimino(triphenyl)-phosphorane was prepared as described previously.17 All other compounds were purchased from Aldrich and used as received.

Nuclear magnetic resonance (NMR) spectra were collected on a Varian Unity Inova 300 MHz instrument equipped with a 4-channel probe (13C, 75.42 MHz; 31P: 121.43 MHz). For 1H and $^{13}C$ NMR, chemical shifts were referenced to the residual proton resonance of the solvent. For $^{31}P$ NMR spectroscopy, the spectra were referenced to H3PO4 (external standard). X-ray photoelectron spectroscopy (XPS) was performed on a Kratos Axis HSi instrument operating at a base pressure of ~$5\times10^{-9}$ mm Hg using monochromatic Al Kα radiation at 15 mA and 13.5 kV. Nanoparticle samples were drop-cast from solution onto clean glass slides. Samples were charge compensated, and binding energies were referenced to carbon 1 s at 284.4 eV. UV-visible spectra were obtained on a Hewlett-Packard 8453 diode array spectrometer with a fixed slit width of 1 nm using 1-cm quartz cuvettes. Thermal gravimetric analysis (TGA) was performed on a TA Instruments Hi-Res TGA 2950 Thermogravimetric Analyzer under nitrogen atmosphere (flow rate 100 mL/min). Samples (1-2 mg) were deposited onto Al pans as powders or by drop-casting from dichloromethane and placed in the instrument until a stable weight was obtained prior to analysis. The samples were heated at a rate of 2° C./min up to 100° C., held at that temperature for 20 min to ensure complete solvent evaporation, and then heated to 500° C. at a rate of 1° C./min. Transmission electron microscopy (TEM) was performed on a Philips CM-12 operating at 120 kV accelerating voltage. Samples were prepared by aerosol deposition of aliquots onto SiOx-coated 400-mesh Cu TEM grids (Ted Pella). The samples were dried under ambient conditions prior to inspection by TEM. Images were recorded and processed as described previously.

Example 1

This example describes a general procedure for the preparation of organic-soluble undecagold nanoparticles. To a solution of $5.0\times10^{-3}$ mmol $Au_{11}(PPh_3)_8Cl_3$ in dichloromethane/1-chlorobutane (1:3; 30 mL), 0.1 mmol of the organic-soluble thiol was added. The mixture was stirred rapidly at 55° C. until completion of the ligand exchange reaction. The reaction time depended on the incoming ligand and varied from 6 hours for propanethiol up to 24 hours for long-chain alkanethiols. Upon completion of the exchange reaction the solvent was removed in vacuo. To remove excess free ligand and by-products, the crude material was dissolved in the minimum amount of ethanol or 2-propanol and purified by gel filtration chromatography using Sephadex LH-20 (eluent: ethanol or 2-propanol; collect colored fraction).

Example 2

This example describes a general procedure for the preparation of water-soluble undecagold nanoparticles. An aqueous solution (15 mL) of 0.1 mmol of the water-soluble thiol ligand was added to a solution of $5.0\times10^{-3}$ mmol $Au_{11}(PPh_3)_8Cl_3$ in $CHCl_3$ (15 mL). The biphasic mixture was stirred rapidly at 55° C. until completion of the ligand exchange reaction which was monitored by the complete transfer of the colored nanoparticles from the organic to the aqueous phase. The reaction time depended on the incoming ligand and varied from 4 to 15 hours. Upon completion of the exchange reaction the layers were separated, and the aqueous layer was washed with CH2Cl2 (3×10 mL) and evaporated in vacuo. The crude material was redispersed in the minimum amount of water and purified by gel filtration chromatography using Sephadex LH-20 (eluent: H2O; collect colored fraction) to remove excess free ligand and by-products.

Alternatively, the crude product were dissolved in H2O and purified by ultracentrifugation for 18 h at 340,000×g. The nanoparticles formed a highly concentrated solution at the bottom of the centrifugation tube which could be separated from the supernatant.

Example 3

This example describes the synthesis of carboxylic acid-functionalized, thiol-stabilized undecagold nanoparticles. An aqueous solution (15 mL) of 0.1 mmol of the ω-carboxyalkanethiol which was buffered to pH 8 using a 0.1 mM KH2PO4/K2HPO4 buffer was added to a solution of $5.0\times10^{-3}$ mmol $Au_{11}(PPh_3)_8Cl_3$ in $CHCl_3$ (15 mL). The biphasic mixture was stirred rapidly at 55° C. until the transfer of the colored nanoparticles from the organic to the aqueous phase was complete. The reaction time depended on the incoming ligand and varied from 3 to 12 hours. The layers were separated, and the aqueous layer was washed with $CH_2Cl_2$ (3×5 mL) and evaporated in vacuo. The residue was dissolved in nanopure water (10 mL) and precipitated by acidifying with 10% HCl to about pH 2. After filtering, the residue was washed with 20 mL 10% HCl, 20 mL H2O, and 5 mL methanol. If higher purity is desired this material can be dissolved in water and further purified by ultracentrifugation for 18 h at 340,000×g. The nanoparticles form a highly concentrated solution at the bottom of the centrifugation tube which could be separated from the supernatant.

Example 4

This example describes NMR monitoring of ligand exchange between $Au_{11}(PPh_3)_8Cl_3$ and thiols. All NMR experiments to monitor the ligand exchange reaction were conducted at 55° C. Hexanethiol was placed in an NMR tube, dissolved in d6-DMSO, and equilibrated in the NMR instrument to 55° C. A single 1H NMR spectrum was obtained as a starting point for the reaction. The contents of the NMR tube were then added to a scintillation vial charged with $Au_{11}(PPh_3)_8Cl_3$. The resulting mixture was quickly agitated until everything had dissolved and placed back into the NMR tube. The NMR tube was returned to the instrument, re-shimmed, and spectra were collected at preset time intervals.

Example 5

This example describes ligand exchange between $Au_{11}(PPh_3)_8Cl_3$ and excess hexanethiol. A solution of hexanethiol (2.8 mg, $2.4\times10^{-2}$ mmol) in d6-DMSO (0.6 mL) was added to 1 (5 mg, $1.2\times10^{-3}$ mmol), and the reaction was monitored by either $^1$H NMR or $^{31}$P spectroscopy. The first spectrum was recorded at $t_0$=1 min followed by spectra every 15 min for a total time of 12 h.

Example 6

Ligand exchange between $Au_{11}(PPh_3)_8Cl_3$ and stoichiometric amount hexanethiol (to replace all nanoparticle-bound phosphines). A solution of hexanethiol (1.5 mg, 0.01 mmol) in d6-DMSO (0.6 mL) was added to $Au_{11}(PPh_3)_8Cl_3$ (5 mg, $1.2\times10^{-3}$ mmol), and the reaction was monitored by 1H NMR spectroscopy. The first spectrum was recorded at $t_0$=1 min followed by spectra every 15 min for a total time of 12 h.

Example 7

Ligand exchange between $Au_{11}(PPh_3)_8Cl_3$ and hexanethiol in the presence of excess $PPh_3$. A solution of hexanethiol (1.5 mg, 0.01 mmol) and PPh3 (10 mg, 0.04 mmol) in d6-DMSO (0.6 mL) was added to 1 (5 mg, $1.2\times10^{-3}$ mmol), and the reaction was monitored by 1H NMR spectroscopy. The first spectrum was recorded at $t_0$=1 min followed by spectra every 15 min for a total time of 12 h.

Example 8

Trapping free $PPh_3$ using 1-azido-2,4-dinitrobenzene. A solution of hexanethiol (2.8 mg, $2.4\times10^{-2}$ mmol) and 1-azido-2,4-dinitrobenzene (10 mg, $4.7\times10^{-2}$ mmol) in d6-DMSO (0.6 mL) was added to 1 (5 mg, $1.2\times10^{-3}$ mmol), and the reaction was monitored by 1H NMR spectroscopy. The first spectrum was recorded at $t_0$=1 min followed by spectra every 1 min for a total time of 625 min.

Discussion

As demonstrated herein the disclosed ligand exchange method is a versatile protocol for preparing functionalized, thiol-stabilized Au11 clusters from a common precursor particle. Specifically described are ligand exchange reactions of $Au_{11}(PPh_3)_8Cl_3$ with a representative family of 22 methyl-terminated or ω-functionalized thiols which include organic- and water-soluble alkane- or arylthiols with neutral or charged head groups. The results described herein demonstrate the general nature of this approach and its tolerance to a wide range of important functional groups. The ease of preparation and convenient purification of the new materials synthesized by this method show its broad utility as a general route to functionalized $Au_{11}$ particles.

A mechanistic investigation of the ligand exchange reaction by NMR spectroscopy also is described that gives fundamental insight into the progression of the exchange reaction and provides evidence that the number of core atoms is preserved during ligand exchange. These results are based upon product formation studies and trapping experiments. Surprisingly and unlike their 1.5-nm analogs, ligand exchange of $Au_{11}(PPh_3)_8Cl_3$ with thiols does not produce $AuCl(PPh_3)$ as a by-product, instead phosphine ligands are liberated from the nanoparticle as free $PPh_3$. Further evidence for the replacement of all phosphine ligands in form of $PPh_3$ is demonstrated by experiments in which blocking of the ligand exchange was attempted through the addition of excess $PPh_3$ to the reaction mixture.

The optical properties of the thiol-stabilized nanoparticles also are characterized herein. Based upon UV-visible spectroscopy, there is a strong dependence of the optical properties on the nature of the ligand shell.

The phosphine-stabilized undecagold precursor particle, $Au_{11}(PPh_3)_8Cl_3$ (1), was synthesized using a modification of a procedure developed by Barlett et al. (Bartlett, P. A.; Bauer, B.; Singer, S. J. *J. Am. Chem. Soc.* 1978, 100, 5085-5089, which is incorporated herein by reference) and had an average core size of 0.8±0.2 nm as determined by TEM. Ligand exchange between $Au_{11}(PPh_3)_8Cl_3$ and alkyl- or arylthiols was achieved by combining an excess of the thiol (~20 molar equivalents) with a nanoparticle solution in an appropriate solvent such as chloroform or water at 55° C. To investigate the full scope of the ligand exchange approach, the ligand exchange was carried out with a representative family of ω-functionalized thiols, including organic- and water-soluble alkane- or aryl-thiols with either neutral or charged head groups (Scheme 1). All thiols tested were compatible with this approach, and only a few ligands (e.g., mercaptophenol, mercaptoethanesulfonic acid) required special reaction conditions to achieve complete exchange. In each case, the approach is generally applicable, leading to complete exchange of the original phosphine ligand shell. See, FIG. 1 for a schematic representation of the ligand exchange reaction of $Au_{11}(PPh_3)_8Cl_3$ and ω-functionalized thiols.

As in the case of exchange reactions of 1.5 nm gold nanoparticles (See, Hostetler, M. J.; Templeton, A. C.; Murray, R. W. *Langmuir* 1999, 15, 3782-3789; and Woehrle, G. H.; Brown, L. O.; Hutchison, J. E. *J. Am. Chem. Soc.* 2005, 127, 2172-2183, both publications are incorporated herein by reference) the reaction time depends on the thiol ligand used. The time increases as the chain length and bulkiness of the incoming ligand increase. However, the ligand exchange of Au11 particles with thiols occurs only at elevated temperatures (~55° C.) and typically requires longer reactions times (approximately twice as long as in the case of 1.5 nm gold nanoparticles) due to the lower reactivity of $Au_{11}$ clusters. $Au_{11}$ clusters are also reported to have slower phosphine-for-phosphine exchange rates than 1.5-nm Au nanoparticles. Ligand exchange reactions with organic-soluble thiols were carried out in a single organic phase and have been applied to a wide variety of alkane- and arylthiols (Scheme 1). Reaction times depended on the incoming ligand and vary from 6 hours for propanethiol to 24 hours for long-chain alkanethiols. Ligand exchange reactions with organic-soluble thiols were initially carried out in chloroform; however, this solvent leads to the rapid decomposition of the precursor cluster (1) and, thus, reduced yield. Filtering the chloroform through basic alumina immediately prior to use improved the yields, but partial decomposition of 1 still occurred. In order to avoid the difficulties arising from particle decomposition in chloroform, a number of alternative reaction media were investigated, including alcohols, ethyl acetate, acetone, and dimethyl sulfoxide. Use of alcohols, ethyl acetate, or acetone eliminated decomposition of 1 but resulted in incomplete exchange due to precipitation of the particles during the exchange. In dimethyl sulfoxide, 1 showed essentially no decomposition and the ligand exchange resulted in completely exchanged nanoparticles indistinguishable from those obtained in chloroform; however, the high boiling point of dimethyl sulfoxide makes its removal from the nanoparticle samples inconvenient. The best results were achieved using a mixture of 1-chlorobutane/dichloromethane (3:1) as the solvent. In this solvent system, ligand exchange resulted in completely exchanged thiol-stabilized Au11 clusters with no decomposition of the precursor clusters.

Water-soluble $Au_{11}$ clusters can also be prepared using this ligand exchange approach if a biphasic solvent system (water/$CHCl_3$) is used in place of the organic solvent. As in the case of monophasic exchanges, the organic layer of the biphasic system can be replaced with a 3:1 mixture of 1-chlorobutane/dichloromethane; however, significant differences in yield using either alumina-filtered chloroform or 1-chlorobutane/dichloromethane as the solvent were not observed. The pH of the aqueous layer was kept between 5 and 8 to avoid decomposition of the precursor particle under acidic conditions and prevent significant disulfide formation at higher pH. Typical reaction times for the biphasic ligand exchange reactions ranged from 4 hours for ligand exchanges with 2-trimethylaminoethanethiol up to 15 hours using 2-[2-(2-mercaptoethoxy)-ethoxy]-ethanol. In exchange reactions involving thiols that contain ionizable head groups (e.g., carboxylic acids), the pH typically is raised to promote deprotonation of the head groups to avoid formation of insoluble material that can prevent complete exchange. In nearly all cases, the use of a phosphate buffer (pH=8) as the aqueous layer yielded the best results. The thiol-stabilized ligand exchange products can be purified either by solvent washes or, more conveniently, by gel filtration chromatography using a resin such as Sephadex LH-20 resin. In practically every case, chromatography is more reliable, less wasteful and faster than solvent washes. The use gel filtration allows for rapid purification of both organic- and water-soluble exchange products with a wide range of solvents, including alcohols, chlorinated organics and water. The recovery of nanoparticle material from the column is nearly quantitative and the support can be reused after sufficient rinsing.

To determine the chemical composition of the thiol-stabilized exchange products and ensure sufficient purity, each exchange product was analyzed using a combination of NMR, UV-visible spectroscopy, TEM, TGA, and XPS (Table 1). $^1$H NMR spectroscopy was used to confirm the purity of each sample. The resonances associated with ligands bound to the gold core show significant line broadening. The absence of sharp resonances indicates that excess free ligand and by-products of the ligand exchange have been removed. When non-aromatic thiols are used for the exchange reaction, 1H NMR spectroscopy can also be used to confirm the completion of the ligand exchange (through the disappearance of the triphenylphosphine signals).

With reference to FIG. 2, the core sizes of the exchange products were determined by analyzing representative TEM images for each nanoparticle sample. The typical average core size of 0.8±0.2 nm (N>500) is the same as the core size of the phosphine-stabilized precursor particle 1 (see Table 1). Because the optical properties of subnanometer gold clusters are highly sensitive to the number of core atoms, determining the core size by UV-visible spectroscopy was considered. However, UV-visible spectroscopy was not useful for probing the nanoparticle core size of the product particles because the optical properties of the nanoparticle are dependent on nature of the ligand shell, as described below. The chemical composition of each exchange product was determined using a combination of XPS and TGA (Table 1). The absence of phosphorous (with the exception of mercaptoethylphosphonic acid stabilized particles) in the XPS analysis confirmed complete ligand exchange and removal of all phosphine-containing by-products within the detection limits of the instrument. For organic-soluble exchange products, XPS analysis also revealed the absence of chloride. Quantitative XPS analyses gave sulfur:gold ratios of organic-soluble exchange products ranging from 0.86:1.00 to 1.01:1.00 which correlate to ~9-11 thiols per nanoparticle. Water-soluble exchange products showed slightly lower sulfur:gold ratios of 0.74:1.00 to 1.02:1.00, corresponding to 8-11 thiols per nanoparticle. The sulfur:gold ratios of the exchange products obtained by XPS and TGA analyses are consistent with one another. The slightly lower thiol coverage of certain water-soluble exchange products suggests that some of the chloride ligands were not displaced.

The ligand exchange approach disclosed herein is general and tolerates a surprisingly wide range of functional groups, using either a mono- or bi-phasic system. The approach produces functionalized $Au_{11}$ particles with technologically relevant head groups such as alcohols for biological applications, phosphonic acids and silanes for surface applications, and quaternary ammonium head groups for self-assembly on DNA templates, making this method useful for the construction of many different conjugates. In addition, the general nature of the approach, in combination with the ease of preparation and convenient purification, allows for the rapid preparation of large families of thiol-stabilized $Au_{11}$ particles.

Only a few mechanistic investigations have been reported that provide information about the course and outcome of ligand exchange reactions of ligand-stabilized nanoparticles. The mechanism for the replacement of the phosphine ligands by thiols was evaluated to determine whether the core size is preserved during ligand exchange. Recent studies of the ligand exchange reaction of 1.5 nm triphenylphosphine-stabilized gold nanoparticles, "$Au_{101}(PPh_3)_{21}Cl_5$", with alkanethiols showed that part of the phosphine ligand shell is replaced as $AuCl(PPh_3)$, leading to loss of core atoms. The amount of $AuCl(PPh_3)$ produced is limited by the number of chlorides available in the original ligand shell which means that about 5% of the core atoms are lost as result of the exchange reaction. In the case of $Au_{11}(PPh_3)_8Cl_3$, a similar, partial replacement of the phosphine ligands as $AuCl(PPh_3)$ would result in the loss of three Au atoms and produce nanoparticles with an $Au_g$ core according to the number of chlorides in the original ligand shell. Since the optical properties of gold clusters with 6 to 13 core atoms are highly sensitive to the number of core atoms, a change from an $Au_{11}$ core to an $Au_8$ during ligand exchange should lead to significant changes in the optical properties of the exchange products. Accordingly the ligand exchange reactions of the $Au_{11}$ core was investigated, specifically, the exchange reaction between 1 and hexanethiol was followed by in situ $^{31}$P NMR spectroscopy to monitor the formation of phosphine-containing by-products. To favor complete exchange, the ligand exchange between 1 and hexanethiol was carried out in an NMR tube at 55° C. using a 20-fold molar excess of the thiol. Deuterated DMSO was chosen as solvent in order to eliminate the decomposition of 1 to $AuCl(PPh_3)$ that occurs rapidly in $CDCl_3$. The exchange reaction was monitored until no more changes in the spectrum were observed (~12 hours). At the end of the reaction, the $^{31}$P NMR spectrum showed a major peak at 26.7 ppm, corresponding to triphenylphosphine oxide, and a small peak at 32.6 ppm which was attributed to a trace amount of $AuCl(PPh_3)$, produced either by partial decomposition of the phosphine-stabilized precursor under the exchange conditions or as by-product of the exchange reaction. Signals for phosphines bound to the $Au_{11}$ core ($\delta$=53.2 ppm) or free $PPh_3$ ($\delta$=−5.5 ppm) were not detected.

Triphenylphosphine oxide can either be formed by oxidation of the phosphine ligands on the nanoparticle surface (i.e., triphenylphosphine oxide is the leaving group of the ligand exchange) or is produced by the subsequent oxidation of liberated $PPh_3$ in solution. In order to determine the origin of triphenylphosphine oxide, a trapping experiment was used to selectively probe for the presence of free $PPh_3$ in solution. 1-Azido-2,4-dinitrobenzene was used as the trapping reagent because it selectively undergoes a fast Staudinger reaction with $PPh_3$ to irreversibly form an iminophosphorane which is readily observable by NMR (Scheme 2). Triphenylphosphine oxide and gold bound $PPh_3$ ligands do not react with the azide under identical conditions. Triphenylphosphine oxide, produced as the leaving group of the ligand exchange reaction, would not result in the formation of iminophosphorane because the trapping reagent does not react with triphenylphosphine oxide. If triphenylphosphine oxide is formed by the oxidation of liberated $PPh_3$, rapid formation of iminophosphorane would be observed. In addition, the amount of triphenylphosphine oxide will be greatly reduced because $PPh_3$ is rapidly removed from the mixture by the irreversible reaction with the trap.

Scheme 2

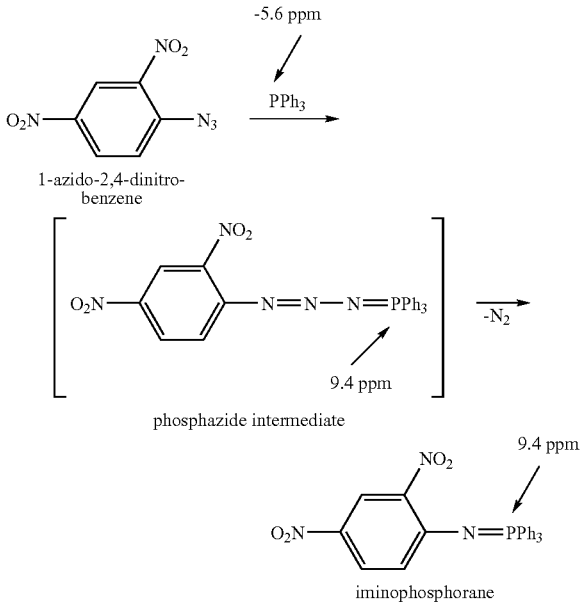

Scheme 2 illustrates the reaction of 1-azido-2,4-dinitrobenzene with triphenylphosphine and the resulting $^{31}P$ NMR chemical shifts. When the ligand exchange reaction of 1 with an excess of hexanethiol is performed in the presence of 1-azido-2,4-dinitrobenzene, the formation of iminophosphorane is observed throughout the course of the ligand exchange reaction. Only trace amounts of triphenylphosphine oxide are produced in the presence of the trapping reagent. Since the formation of iminophosphorane only occurs in the presence of free $PPh_3$ in solution, this observation indicates that the phosphine ligands dissociate from the clusters as free $PPh_3$, but not as triphenylphosphine oxide.

When the ligand exchange reaction of 1 with an excess of hexanethiol is performed in the presence of 1-azido-2,4-dinitrobenzene, the formation of iminophosphorane is observed throughout the course of the ligand exchange reaction. Only trace amounts of triphenylphosphine oxide are produced in the presence of the trapping reagent. Since the formation of iminophosphorane only occurs in the presence of free $PPh_3$ in solution, this observation indicates that the phosphine ligands dissociate from the clusters as free $PPh_3$, not triphenylphosphine oxide.

To investigate if the trace amount of $AuCl(PPh_3)$ observed during the initial NMR studies was formed as a leaving group of the ligand exchange or was a result of the slow decomposition of 1 under the reaction conditions, ligand exchange was blocked the ligand exchange by addition of an excess of free $PPh_3$ to the ligand exchange mixture. Addition of excess of $PPh_3$ to the reaction mixture should only inhibit the loss of phosphine ligands as free $PPh_3$ but not their replacement as $AuCl(PPh_3)$. If $AuCl(PPh_3)$ was a leaving group of the ligand exchange addition of excess $PPh_3$ should only lead to partial blocking of the ligand exchange.

FIGS. 3A and 3B illustrate the effect of addition of excess $PPh_3$ to the ligand exchange mixture on the progression of ligand exchange. The extent of ligand exchange can be monitored by the change in intensity of the 1H NMR resonance for the α-methylene protons ($CH_2$ protons closest to the sulfur) as the incoming thiol is exchanged onto the nanoparticle surface. In FIG. 3A, the evolution of the α-methylene proton peaks is shown as a function of time for a ligand exchange reaction between 1 and a stoichiometric amount of hexanethiol to completely replace all of the ligands of 1 (~11 molar equivalents of thiol to $Au_{11}(PPh_3)_8Cl_3$). As the ligand exchange progresses, the intensity of the $^1H$ NMR resonance for the α-methylene protons decreases until it broadens into the baseline towards the end of the exchange reaction. Approximately 200 min after the start of the ligand exchange, the resonance for the α-methylene protons of the free thiol is not observable by NMR, indicating that all thiol is removed from solution and exchanged completely onto the nanoparticle.

Figure 4:
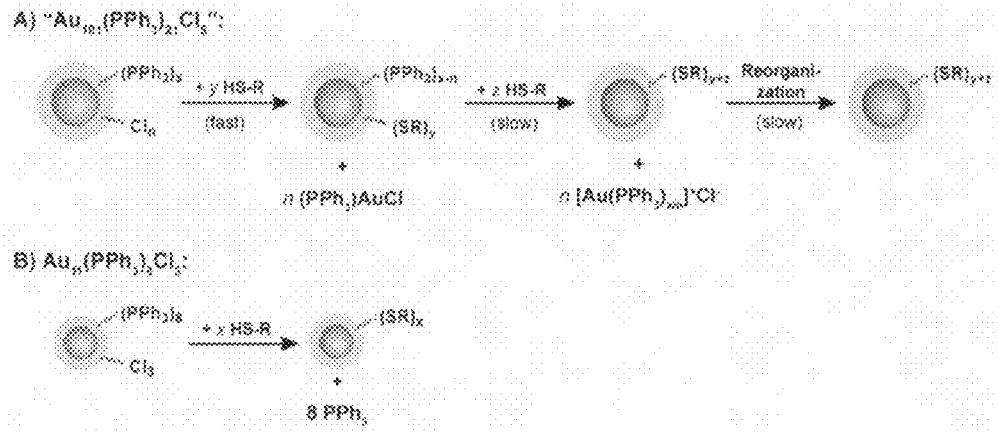
FIG. 4 depicts two different ligand exchange reaction mechanisms.

FIG. 3B illustrates the evolution of the α-$CH_2$ protons over time for a ligand exchange reaction between 1 and stoichiometric hexanethiol in the presence of a 4-fold molar excess of $PPh_3$ over the amount of hexanethiol. In contrast to the exchange reaction without the addition of excess $PPh_3$ shown in FIG. 3A, the intensity of the resonance the α-methylene protons remains unchanged over the complete course of the experiment (~420 min) as indicated by the constant integration ratio of the α-$CH_2$ protons and the terminal methyl protons. These results show that no thiol is removed from solution in the presence of an excess $PPh_3$, indicating that the ligand exchange reaction is blocked completely. Complete inhibition of the ligand exchange by an excess of $PPh_3$ provides additional evidence that all phosphine ligands are liberated from the nanoparticle as free $PPh_3$ because loss of the phosphine ligands as $AuCl(PPh_3)$ would lead to partial ligand exchange. Therefore, the observed $AuCl(PPh_3)$ is most likely caused by partial decomposition of 1 under the reaction conditions and not a result of the ligand exchange. The experimental evidence from both the trapping studies and the blocking experiment suggest that the ligand exchange of Au11 clusters with thiols follows a different reaction mechanism than the analogous exchange involving "$Au_{101}(PPh_3)_{21}Cl_5$". The ligand exchange of "$Au_{101}(PPh_3)_{21}Cl_5$" with thiols proceeds in a three-stage mechanism in which about 25% of the phosphine ligands are replaced as $AuCl(PPh_3)$ during the initial stage of the ligand exchange. The remaining phosphine ligands are removed in a subsequent stage by transfer to closely associated $AuCl(PPh_3)$ to form poly-phosphine Au complexes. During the final stage of the exchange reaction the thiol ligand shell is being completed and reorganizes into a more crystalline state (Scheme 3A, FIG. 4). In the case of $Au_{11}(PPh_3)_8Cl_3$, $AuCl(PPh_3)$ is not produced as a leaving group ligand exchange with thiols. Instead, the complete ligand shell is removed in form of free $PPh_3$ (Scheme 3B, FIG. 4). The results from these mechanistic studies provide strong evidence that the $Au_{11}$ core remains intact during the ligand exchange reaction, demonstrating the ability to control the core size of the product particles during the synthesis of the phosphine-stabilized precursor nanoparticles. Thus, using the methods disclosed herein, it is possible to predict the core size of the product particles from the core size of the precursor.

Optical Properties of the Thiol-Stabilized Product Particles

Access to a large family of functionalized Au11 particles provided by the ligand exchange method offers the opportunity to exploit the influence of the ligand shell on the optical properties. Phosphine-stabilized $Au_{11}$ clusters have a characteristic UV-vis spectrum with maxima at 415, 385, and 301 nm which are only slightly sensitive to changes in the phosphine and halide ligands. Storage of water-soluble Au11 clusters at low pH or addition of oxidizing agents leads to noticeable shifts of the maxima to 425, 366, and 324 nm. These changes are reversible on addition of a small amount of a reducing agent (e.g., $NaBH_4$), and, without limitation to theory, are believed to reflect some rearrangement in the gold core. The optical properties of several thiol-stabilized $Au_{11}$ cluster also have been studied recently. Chen et al. (Chen, S.; Ingrma, R. S.; Hostetler, M. J.; Pietron, J. J.; Murray, R. W.; Schaaff, T. G.; Khoury, J. T.; Alvarez, M. M.; Whetten, R. L. *Science* 1998, 280, 2098-2101) investigated the electronic structure of dodecanethiol-stabilized $Au_{11}$ ($Au_{11}$—SC12) by voltammetric and spectroscopic measurements. By comparing the voltammograms of $Au_{11}$—SC12 with those of $Au_{11}(PPh_3)_7Cl_3$, they found that the band gap of the thiol-stabilized cluster is about 0.35 eV larger than for the phosphine-stabilized cluster. Under the assumption that the core dimensions remain unchanged during the exchange reactions, this observation was attributed to the stronger bonding of Au—S compared to that of Au—P(Cl). Furthermore, the authors found that thiol-stabilized $Au_{11}$ clusters (in contrast to the phosphine-stabilized precursor particles) exhibit photoluminescence and behave similarly to indirect band-gap semiconductors. Distinct differences in the optical spectra of organic-soluble and water-soluble thiol-stabilized exchange products were observed (FIG. 5). Undecagold particles stabilized with long-chain alkanethiols, such as octadecanethiol (ODT), have similar absorbance spectra to the phosphine-stabilized precursor 1 with maxima at 318 nm, 330 nm, 375 nm and 416 nm (due to interband transitions) but show an additional, broad peak at 690 nm. The latter peak was attributed to the excitonic transition of the subnanometer core and is believed to reflect the semiconductor character of the Au11 cluster. In contrast to the spectrum of ODT-stabilized $Au_{11}$, the spectra for water-soluble exchange products do not show defined peaks (FIG. 5; chart A).

A surprising trend was observed for the optical properties of organic-soluble, thiol-stabilized $Au_{11}$ particles when the chain length of the stabilizing alkanethiol ligand was decreased. FIG. 5, chart B, shows the optical spectra of thiol-stabilized Au11 particles with ligand shells composed of octadecanethiol, dodecanethiol, octanethiol, and hexanethiol. In this series of straight-chain alkanethiol-stabilized $Au_{11}$ particles, the defined maxima at 318 nm, 330 nm, and 416 nm broadened more and more with decreasing chain length of the thiol ligands. The Au11-SC18 particles showed the signature peaks of $Au_{11}$ particles observed in the absorbance spectrum of 1; however, the optical spectra the $Au_{11}$ particles stabilized with the shortest thiol in the series, hexanethiol, resembled the optical spectra of water soluble, thiol-stabilized $Au_{11}$ particles. This trend was unexpected considering the fact that the only known difference between the $Au_{11}$ clusters was the chain length of the stabilizing thiol ligand.

Figure 6:
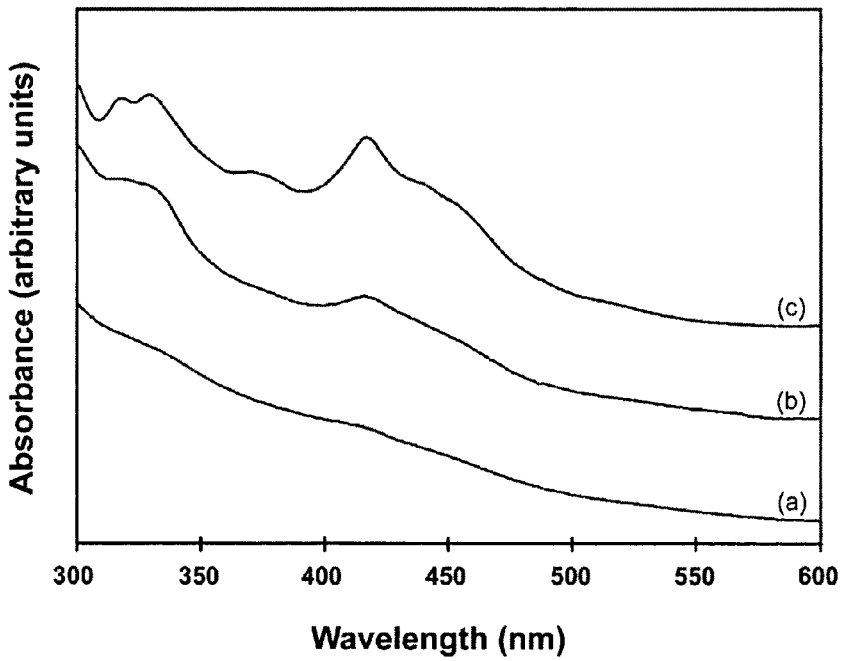
FIG. 6 includes UV-visible spectra of three different thiol-stabilized nanoparticles.

A possible explanation for the observed differences in the optical spectra are changes in core size and size dispersity. Optical and electronic properties of subnanometer gold clusters are strongly dependent on the number of core atoms. Although mechanistic studies suggested that no core atoms are lost during ligand exchange, it was possible that ligand exchange lead to ripening and rearrangement of nanoparticle core, resulting in polydisperse samples. To probe if the differences in core size and dispersity cause the different optical spectra of short-chain and long-chain thiol-stabilized $Au_{11}$ particles, $Au_{11}$—$SC_{18}$ particles were prepared by ligand exchange of hexanethiol-stabilized $Au_{11}$ particles ($Au_{11}$—$SC_6$), with ODT and the absorbance spectrum was compared with that of $Au_{11}$—$SC_{18}$ prepared directly by ligand exchange of 1 with ODT. Thiol-for-thiol ligand exchanges have been show to preserve the core size; thus, the $Au_{11}$—$SC_{18}$ particles prepared from $Au_{11}$—$SC_6$ particles should possess the same core dimensions as the $Au_{11}$—$SC_6$ precursor. FIG. 6 shows the absorbance spectra of a sample of $Au_{11}$—$SC_6$ particles before and after ligand exchange with ODT. Before ligand exchange, the spectrum was featureless, as is typical for undecagold particles stabilized by short-chain alkanethiols (FIG. 6, trace a). After ligand exchange of this sample with ODT (FIG. 6, trace b), the spectrum was similar to the spectrum of $Au_{11}$—$SC_{18}$ synthesized directly from $Au_{11}(PPh_3)_8Cl_3$ with two distinct maxima at 322 nm and 416 nm (FIG. 6, trace c).

The similarity between the spectra of the two $Au_{11}$—$SC_{18}$ samples prepared by the two methods suggests that both materials possess the same core size; suggesting that the initial thiol-for-phosphine ligand exchange of 1 as well as the subsequent thiol-for-thiol exchange reaction preserve the undecagold core. The absorbances in the spectrum of $Au_{11}$—$SC_{18}$ by ligand exchange of $Au_{11}$—$SC_6$ and ODT were not as defined as in the spectrum of $Au_{11}$—$SC_{18}$ synthesized directly from $Au_{11}(PPh_3)_8Cl_3$. A possible explanation for this observation is the presence of nanoparticles with mixed hexanethiol/ODT ligand shells. Thiol-for-thiol ligand exchange reactions of larger gold nanoparticles are typically incomplete and result in particles with mixed ligand shells. Thus, without being limited to theory, it is believed that the differences in the optical spectra were due to effects of the ligand shell and not to differences in core size and dispersity. As demonstrated herein, different ligand shells of the nanoparticle samples affected the optical properties by influencing interparticle interactions and aggregation. Since these phenomena are concentration-dependent, the optical properties of long- and short-chain thiol-stabilized $Au_{11}$ particles were studied over a concentration range of 0.2 mM to 3.0 mM. A linear relationship between the absorbance and the concentration was observed, indicating that interparticle interactions or aggregation do not have noticeable effects on the optical spectra.

Solvation effects also were considered as a cause of the observed difference in the optical properties. The optical properties of thiol-stabilized $Au_{11}$ particles were studied in various solvents including chloroform, ethanol, toluene, THF, and 1-chlorobutane, but a noticeable dependence on the nature of the solvent in the investigated concentration range was not observed. Optical studies indicate that during ligand exchange reactions of 1 with thiols no core size changes occur, confirming the results from the mechanistic investigation. Furthermore, interparticle interactions and solvation effects have been ruled out as being responsible for the pronounced dependence of the optical properties of alkanethiol-stabilized $Au_{11}$ particles on the chain length of the thiol ligands. These results suggest that the nature of the thiol ligand has a direct influence on the electronic structure of the $Au_{11}$ core. This offers the opportunity to tune the optical properties of nanoparticles with the same core size through choice of the ligand shell.

As demonstrated herein, the ligand exchange chemistry of phosphine-stabilized $Au_{11}$ clusters with ω-functionalized thiols is a powerful synthetic method that provides convenient access to a diverse family of functionalized $Au_{11}$ clusters. The general nature of the presented ligand exchange approach, in combination with the ease preparation, makes this approach of broad utility. The approach is general and shows the high tolerance for a wide variety of functional groups. Mechanistic studies provided conclusive evidence that the $Au_{11}$ core of the precursor particle remains intact during ligand exchange and showed that the ligand exchange of these particles follows a different pathway than for ligand exchanges of larger gold nanoparticles such as "$Au_{101}(PPh_3)_{21}Cl_5$". Optical studies of the products show a strong dependence on the nature of the stabilizing thiol ligands. The ligand exchange approach offers the opportunity to study and tune systematically the optical and electronic properties of the nanoparticles through manipulation of the ligand shell.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A gold nanoparticle, comprising:

from 8 to 10 gold atoms; and a ligand having the formula —SRX, wherein R represents $—(CH_2)_n—$; optionally substituted arylene; $—(CH_2CH_2O)_n—$; or $—(CH_2CH_2O)_nCH_2CH_2—$;

X represents $—R^1$; $—SiR^3R^4R^5$; $—P(O)(OR^2)_2$; $—N(CH_3)_3Cl$; $—Si(OCH_3)_3$; $—(CH_2)_3Si(OCH_3)_3$; or $—OR^1$; each n independently is an integer from 1 to 20;

$R^1$ is H or lower alkyl;

$R^2$ is H, lower alkyl, aralkyl or aryl; and $R^{3-5}$ independently are selected from lower alkyl and lower alkoxy.

2. The nanoparticle of claim 1, wherein R is selected from the group consisting of $—CH_2CH_2OCH_2CH_2OCH_2CH_2—$; $—CH_2CH_2—$; and $—CH_2CH_2OCH_2CH_2—$; optionally substituted phenylene and optionally substituted biphenylene.

3. The nanoparticle of claim 1, wherein R is phenylene and X is $—OR^1$.

4. A gold nanoparticle, comprising:

from 8 to 11 gold atoms; and a ligand having the formula —SRX, wherein R is $—(CH_2CH_2O)_nCH_2CH_2—$;

X represents $—R^1$; $—SiR^3R^4R^5$; $—P(O)(OR^2)_2$; $—N(CH_3)_3Cl$; or $—OR^1$ and n is 1, 2 or 3;

$R^1$ is H or lower alkyl;

$R^2$ is H, lower alkyl, aralkyl or aryl; and $R^{3-5}$ independently are selected from lower alkyl and lower alkoxy.

5. The nanoparticle of claim 4, wherein X is $—Si(OCH_3)_3$ or $—N(CH_3)_3Cl$.

6. The nanoparticle of claim 5, wherein n is 1 and X is $—N(CH_3)_3Cl$.

7. The nanoparticle of claim 5, wherein n is 2 and X is $—N(CH_3)_3Cl$.

8. The nanoparticle of claim 5 wherein n is 1 and X is $—Si(OCH_3)_3$.

9. A gold nanoparticle, comprising:

from 8 to 11 gold atoms; and a ligand having the formula —SRX, wherein R represents $—(CH_2)_n—$; $—(CH_2CH_2O)_n—$; or $—(CH_2CH_2O)_nCH_2CH_2—$;

X represents $—P(O)(OR^2)_2$;

$R^1$ is H or lower alkyl;

$R^2$ is H; and n is from 2 to 12.

10. The nanoparticle of claim 9, wherein R represents $—S(CH_2CH_2)_nP(O)(OH)_2$ and n is 2, 3, 5 or 10.

11. A gold nanoparticle, comprising:

from 8 to 11 gold atoms; and a ligand having the formula —SRX, wherein R represents $—(CH_2)_n—$; and X is $—Si(OCH_3)_3$.

12. An undecagold nanoparticle, having at least one ligand of the formula

—SRX, wherein R represents $—(CH_2)_n—$; optionally substituted arylene; $—(CH_2CH_2O)_n—$; or $—(CH_2CH_2O)_nCH_2CH_2—$;

X represents $—R^1$, $—Si(OCH_3)_3$; $—N(CH_3)_3Cl$; or $—R^1$;

each n independently is an integer from 1 to 10; and $R^1$ is H or lower alkyl.

13. The nanoparticle of claim 12, wherein R is selected from the group consisting of $—CH_2CH_2OCH_2CH_2OCH_2CH_2—$; $—CH_2CH_2—$; and $—CH_2CH_2OCH_2CH_2—$; optionally substituted phenylene and optionally substituted biphenylene.

14. The nanoparticle of claim 12, wherein R is phenylene and X is $—OR^1$.

15. The nanoparticle of claim 12, wherein R is $—(CH_2CH_2O)_nCH_2CH_2—$ and n is 1, 2 or 3.

16. The nanoparticle of claim 15, wherein X is $—Si(OCH_3)_3$ or $—N(CH_3)_3Cl$.

17. The nanoparticle of claim 15, wherein n is 1 and X is $—N(CH_3)_3Cl$.

18. The nanoparticle of claim 15, wherein n is 2 and X is $—N(CH_3)_3Cl$.

19. The nanoparticle of claim 15 wherein n is 1 and X is $—Si(OCH_3)_3$.

* * * * *